United States Patent [19]

Listle et al.

[11] 4,200,034

[45] Apr. 29, 1980

[54] ENERGY CONSERVING CONSTRUCTION

[75] Inventors: Kenneth N. Listle; Ernest F. Shreeves, both of Largo, Fla.

[73] Assignee: Listle/Shreeves, Inc., Largo, Fla.

[21] Appl. No.: 896,432

[22] Filed: Apr. 13, 1978

[51] Int. Cl.[2] ..... F24F 7/06

[52] U.S. Cl. ..... 98/40 C; 52/39; 52/220; 93/40 DC

[58] Field of Search ..... 98/33 R, 33 A, 40 C, 98/40 DL; 52/27, 28, 39, 220, 221, 406; 220/3.3, 3.4, 3.9; 248/DIG. 6

[56] References Cited

U.S. PATENT DOCUMENTS

| | | | |
|---|---|---|---|
| 2,263,201 | 11/1941 | Wheeler et al. | 52/406 X |
| 2,293,776 | 8/1942 | Steber | 220/3.3 |
| 2,561,290 | 7/1951 | Payant | 237/53 |
| 3,462,897 | 8/1969 | Weinrott | 52/169 |
| 3,500,596 | 3/1970 | Andersson | 52/79 |
| 3,683,785 | 8/1972 | Grange | 98/35 |
| 3,722,171 | 3/1973 | Godley | 52/745 |
| 3,823,652 | 7/1974 | Lambert | 98/40 C |
| 3,852,974 | 12/1974 | Brown | 62/175 X |
| 3,913,292 | 10/1975 | Braekkan | 52/406 |
| 3,969,860 | 7/1976 | Bentley | 52/261 |
| 3,972,164 | 8/1976 | Grange | 52/95 X |

FOREIGN PATENT DOCUMENTS

| | | | |
|---|---|---|---|
| 2,320,498 | 11/1974 | Fed. Rep. of Germany | 52/39 |

*Primary Examiner*—William E. Wayner
*Assistant Examiner*—William E. Tapolcai, Jr.
*Attorney, Agent, or Firm*—Cushman, Darby & Cushman

[57] ABSTRACT

An energy conserving building having an interior living area, an attic, and a ceiling completely isolating the attic from the interior living area. Ductwork for forced-air heating and cooling is mounted within the interior living area, completely exterior of the attic. Soffits may be provided mounting the ductwork against the ceiling and an interior wall, the soffits also forming a trough for indirect lighting. No water pipes, electric cables, or the like enter the attic either, and all lighting fixtures are mounted so that they are exterior of the attic, being disposed below the ceiling in false ceilings or the like. The roof has an 8/12 pitch with overhang vents and a continuous ridge vent for continuous natural air circulation. When the exterior walls are masonry blocks, insulation is provided between each interior partition and an adjoining exterior wall and the electrical outlets are mounted adjacent, but not in, the blocks. Triple furring strips are disposed against the exterior walls with insulation between the furring strips. Two separate air conditioners are provided, one providing the cooling under normal load conditions, and the other becoming operational only when the load conditions are excessive.

13 Claims, 6 Drawing Figures

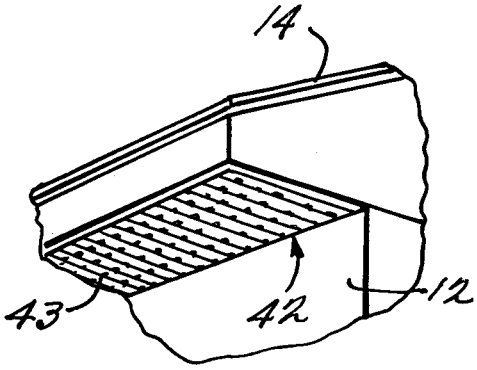
Fig. 5
Fig. 1
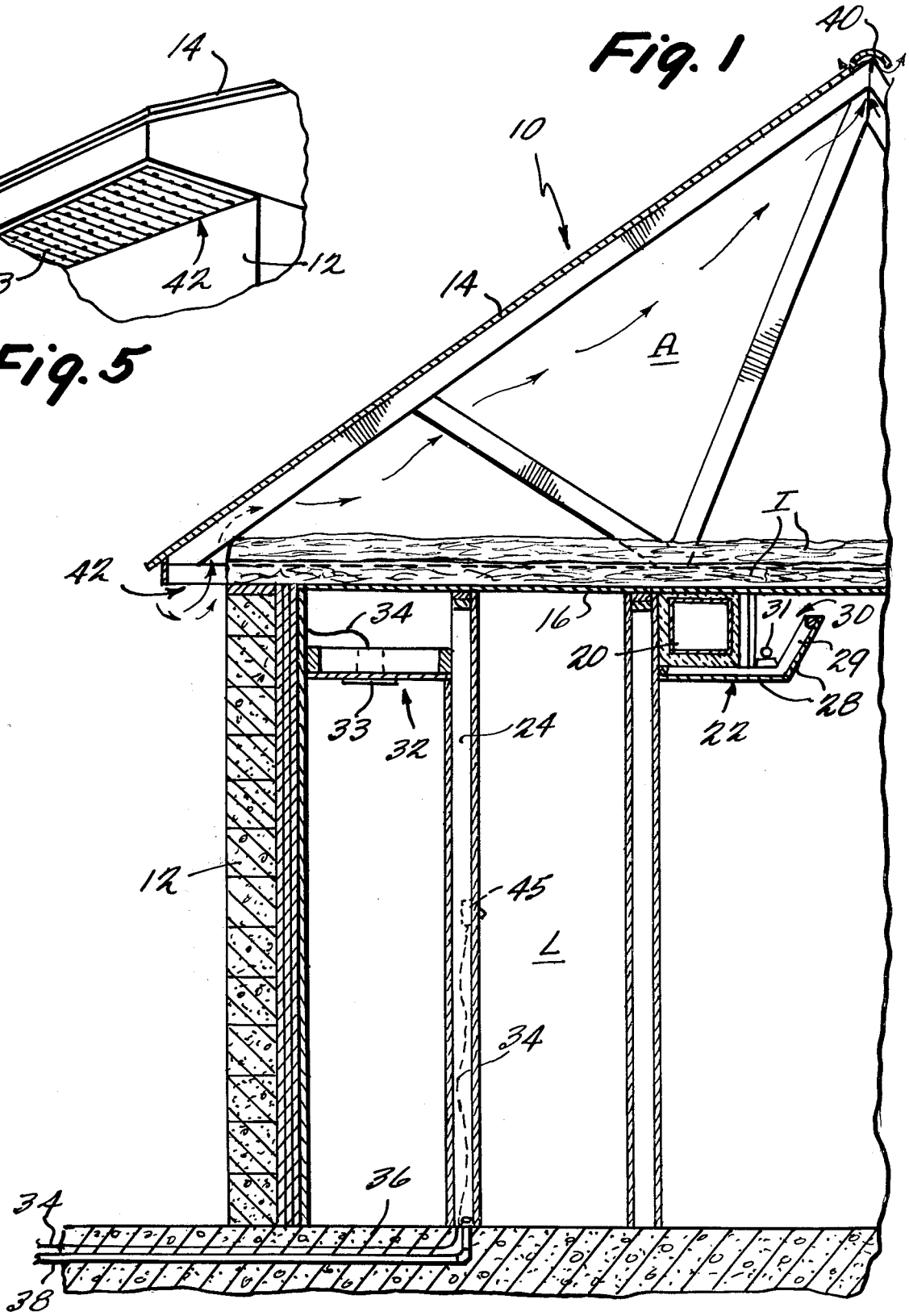

ENERGY CONSERVING CONSTRUCTION

BACKGROUND AND SUMMARY OF THE INVENTION

With the decreasing availability of conventional fuel sources and the increasing costs of energy for space heating and cooling, it is extremely desirable to be able to construct buildings which use a minimum of energy for space heating and cooling. However, it is necessary to do so without excessively increasing the initial costs of the building.

In order to achieve increased energy efficiency, especially in relatively warm climates, it is necessary to give careful consideration to insulation, ventilation, air infiltration control, air conditioning, and hot water heating, and integrate all of the building components to take these factors into account.

According to the present invention, it is possible to construct a house, that is relatively speaking, little more expensive than conventional constructions, yet has fantastically reduced energy requirements for space heating and cooling, and water heating; about ½ the energy requirements for a conventional house, with an increase in construction costs of only approximately 5%. According to the present invention, it is possible to construct masonry block houses that have low energy requirements for space heating and cooling. In conventional masonry block houses, the attic is in fluid communication with a great deal of the interior living space of the house, air from the attic being capable of passing through the conventional insulation and through the interior walls and out through electrical plugs, wiring openings, lighting fixtures, and the like, and the air ducts are located in the attic which causes a large heat transfer into the attic (the ducts to a large extent heating or cooling the attic space) and causing sweating or damp spots during the summer. According to the present invention, such problems inherent in conventional buildings are eliminated by sealing the attic from the interior living space, running all of the electrical wiring and water pipes up through the floor instead of through the attic, and by mounting the ductwork within the interior living space.

Additionally, in conventional masonry construction, single furring strips are placed on the walls, interior partitions abut the walls directly, and electrical outlets are placed in holes formed in the walls. Such construction is extremely energy inefficient. According to the present invention, a much more efficient structure is provided by mounting the electrical outlets adjacent, but not in, the masonry block exterior walls, placing insulation between the interior partitions and the walls, and putting triple furring strips against the walls with insulation extending between the furring strips.

Also, according to the present invention, improved ventilation is provided in the attic by providing the roof with approximately an 8/12 pitch, providing a ridge vent on top of the roof, and providing vents in the roof overhang so that cool air is drawn up through the vents, passing through the attic, and exhausting out the ridge vents. Air conditioning is provided by two separate units, one of which is operational during normal load conditions, and the other which becomes operational only when the load conditions are excessive.

By practicing the present invention, it is possible to significantly increase ventilation and insulation while reducing air infiltration and minimizing hot water heating and air conditioning requirements so that energy usage for space heating and cooling can be cut in half with only a small increase in original construction costs. It is thus the primary object of the present invention to provide buildings with increased energy efficiency, and this and other objects of the invention will become clear from an inspection of the detailed description of the invention, and from the appended claims.

BRIEF DESCRIPTION OF THE DRAWINGS

FIG. 1 is a cross-sectional view of a portion of an exemplary building according to the present invention;

FIG. 5 is a perspective detail view showing the vent for admitting air into the attic space in the building of FIG. 1.

DETAILED DESCRIPTION OF THE DRAWINGS

Figure 3:
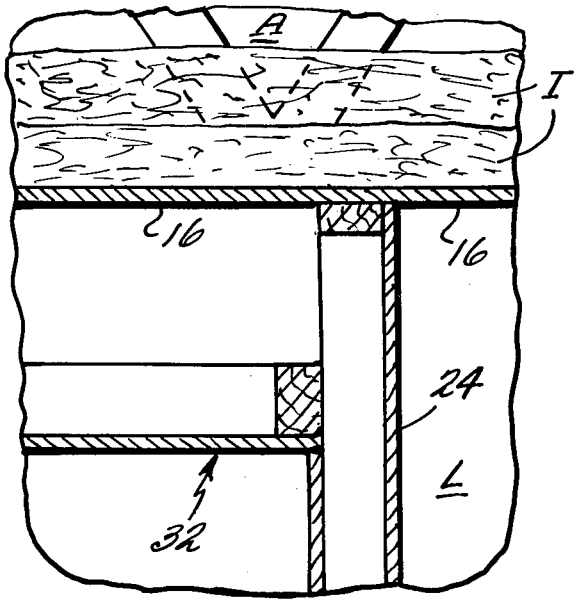
FIG. 3 is a detail cross-sectional view showing the connection between interior partitions, the ceiling, and the like of the building of FIG. 1.

An exemplary building according to the present invention is shown generally at 10 in FIG. 1. The building 10 comprises a plurality of exterior walls 12 (preferably of masonry block), defining an interior living area L, a roof 14, defining an attic A, and a ceiling 16 disposed between the roof 14 and area L and completely isolating the attic A from the area L. Air temperature treatment means 18 (see FIG. 6) are provided for heating and/or cooling of the area L, ductwork 20 being provided for transferring treated air from the temperature treating means 18 throughout the living area L, and means 22 for mounting the ductwork 20 within the interior living area and exterior of the attic A, adjacent the ceiling 16. By separating the attic A from the living space L according to the present invention, the insulation and air filtration properties of the building 10 are greatly improved since air from the attic A, which will invariably be colder or hotter than that desired in living area L, cannot pass through interior partitions, ceiling fixtures, wiring conduits, or the like into the living space L. As shown most clearly in FIG. 3, the interior partitions 24 are installed only after the ceiling 16 is installed, and a thick blanket of insulation I (i.e., R-26) is provided on top of the ceiling 16.

Figure 2:
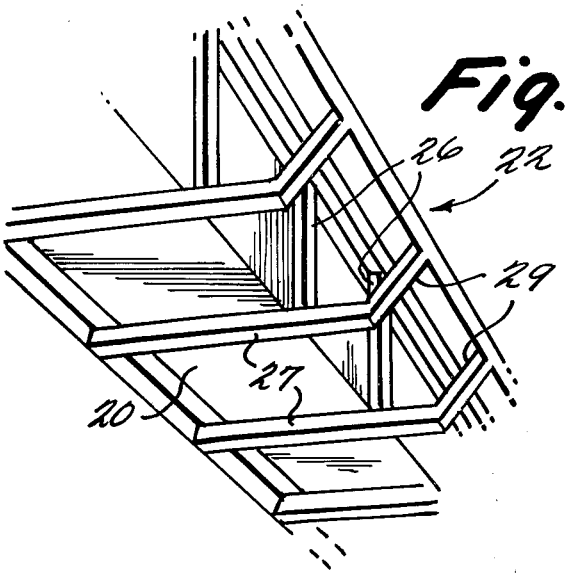
FIG. 2 is a perspective detail view showing mounting of the air ducts within the living space of the building of FIG. 1.

Also, according to the present invention, the mounting of the ductwork 20 within the living space L greatly reduces the heating and cooling requirements, and prevents the formation of damp spots in the attic, and subsequently the ceiling, which can form in conventional houses during the summertime. The duckwork mounting means 22 is shown most clearly in FIGS. 1 and 2, and preferably comprises at least one soffit for mounting the ductwork 20 against the ceiling 16 and against an interior wall 24, the soffit comprising a supporting framework including side 26 and bottom 27 bars engaging a side and the bottom of the ductwork 20. Covering material 28, such as conventional ceiling tile or the like, is disposed over at least the bottom bars 27 of the soffit 22, the ductwork being completely hidden in the living area L.

A plurality of ceiling fixtures, 31, 33, also are provided within the living space L, and means are provided for mounting all of the ceiling fixtures so that they are exterior of the attic A and disposed below the ceiling 16. One form that such mounting means can take is the trough forming means 30 associated with the soffit 22. Extensions 29 of the soffit framework extend outwardly from the bars 26, 27, and terminate short of the ceiling 16 (see FIG. 1), forming trough 30 and means 31 for mounting a lighting fixture in the trough 30 are provided, indirect lighting being provided by the light in the fixture 31. Additionally, the lighting fixture mounting means may take the form of a false ceiling 32 (see FIGS. 1 and 3) mounted below the ceiling 16, electrical wiring 34 extending from light fixture 33 so that it does not pass into the attic A, but rather passes downwardly to the concrete slab 36 or the like on which the exterior walls 12 are mounted.

As can be seen most clearly in FIG. 1, all electrical wiring 34 and the hot water lines 38 (which preferably are insulated) run underground and pass upwardly through openings in the slab 36 rather than extending into the attic A. The provision of the isolating ceiling 16, the soffit mounting 22 for the ducts 20, and the underground running of the wires 34 and pipes 38 minimizes the air infiltration into the living space L, facilitates the provision of good insulation, and in general minimizes the heating and air conditioning requirements.

According to the present invention, it is possible to provide adequate ventilation in the attic without requiring a fan, or like energy consuming device. Adequate attic ventilation is especially important during the summer months when the temperature in the conventional attic can reach 150°, putting an excessive load on the cooling equipment. According to the present invention, adequate attic ventilation is provided by providing the roof 14 at a greater pitch than normal, and providing adequate vents at the bottom and top of the roof. The pitch of the roof 14 is preferably about 8/12, with a continuous ridge vent 40 being provided at the apex of the roof, and an overhang 42 extending horizontally past the exterior walls 12 (see FIGS. 1 and 5), with vent means 43 disposed in the overhang 42 for allowing the admission of air into the attic A so that it is heated and rises and passes out the ridge vent 40 by natural convection. The vent means 43 may be provided by aluminum fascia and an aluminum vented soffit, as shown in FIG. 5.

Figure 4:
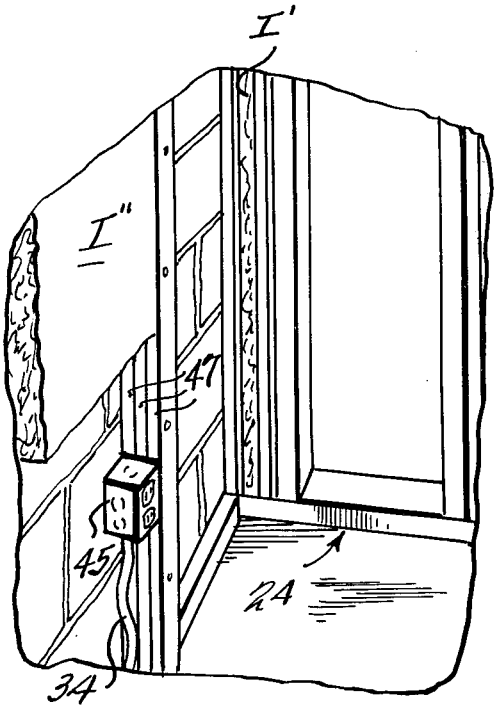
FIG. 4 is a perspective view showing the interface between an interior partition and the exterior wall of the building of FIG. 1 during construction.

In constructing a building 10 according to the present invention, it is also necessary to ensure adequate insulation in the masonry block exterior walls 12. This is facilitated according to the present invention by sealing the exterior walls 12 (i.e., with Visqueen) to form a vapor barrier, disposing insulation I' (see FIG. 4) between each interior partition 24 and an adjoining exterior wall 12, mounting electrical outlets 45 so that they are adjacent, but not in, the masonry block exterior walls (i.e., by mounting them on furring strips 47), and providing triple furring strips 47 and insulation I" extending between the furring strips 47 and between the exterior walls 12 and interior wall board. Preferably, the triple furring strips 47 provide about 2⅜ inch of space between the exterior walls 12 and the interior wallboard, sufficient to mount the electrical outlets 45 so that they are adjacent, but not in, the masonry blocks, and for providing insulation with an R factor of at least 8.

Figure 6:
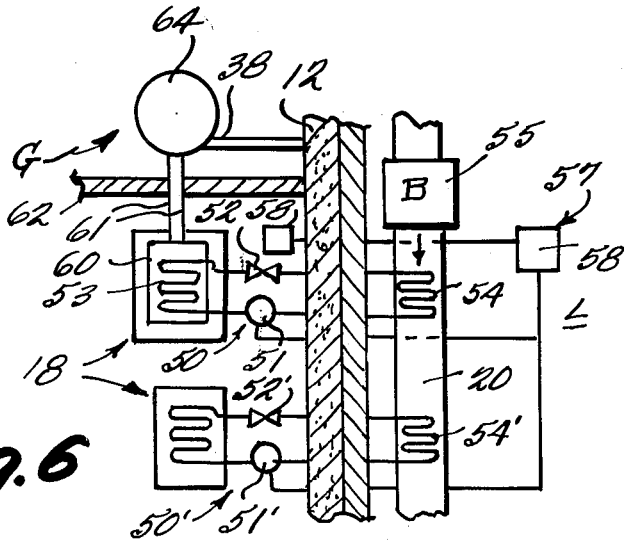
FIG. 6 is a schematic showing of the air conditioning and hot water heating system for the building of FIG. 1.

Exemplary air temperature treatment means 18 according to the present invention are illustrated schematically in FIG. 6, such means preferably comprising first 50 and second 50' refrigerant circulating coil systems. The first refrigerant circulating coil system 50 includes a compressor 51, expansion valve 52, and temperature transfer coils 53, 54 disposed exteriorly and interiorly of the walls 12 respectively. The second system 50' also includes corresponding components including a compressor 51', expansion valve 52', and coils 53', 54'. When the systems comprise a vapor-compression refrigeration system, the coil 53 is a condenser and the coil 54 is the evaporator. Where the systems 50, 50' comprise heat pumps, in the summer the coils 53, 53' will be condensers and the coils 54, 54' evaporators, and vice versa in the winter. The system 50 has a first capacity which is great enough for satisfying the normal cooling and/or heating requirements of the building 10 (i.e., 2 ton), while the system 50' has a second capacity which is preferably less than the first capacity (i.e., 1½ tons) and only is utilized when the temperature conditions are not normal and extra capacity is required. The provision of this dual system greatly reduces the energy requirements for cooling and/or heating.

The air temperature treatment system 18 according to the invention also includes a single air moving means (i.e., blower) 55 for transferring air across the coils 54, 54' to change the temperature of the air and move it into the interior living space L of the building, and means 57 for controlling the coil systems 50, 50' so that the first system 50 is operational while the second system 50' is not during normal conditions, below the first capacity level, and so that both systems 50, 50' are operational during conditions above the first capacity level. The controlling means 57 includes conventional temperature responsive components, such as a conventional two stage thermostat 58.

It is possible to greatly reduce the hot water heating needs during summertime of the building 10 without any further significant energy input, and additionally reduce the space cooling needs at the same time. This is accomplished according to the present invention by providing a hot water heat exchanger 60 in operative association with the condenser coil 53 for extracting the heat energy from the coil 53, the hot water passing from the heat exchanger 60 through line 61 to a hot water tank 64. A garage G also may be provided for the building 10 having an exterior garage wall 62, and the hot water heater 64 is mounted within the garage G, the pipes 38 leading from the water heater 64 underneath the exterior walls 12 into the living area L. By locating the water heater in such a manner, heat transfer across the water heater does not raise the temperature inside the living space L, thus effectively minimizing the cooling needs. Also, other steps may be taken to minimize hot water requirements such as providing an insulation jacket on the water heater 64, insulating all the hot water lines 38, and providing a small hot water circulator installed in a continuous hot water line loop from the tank 64 to the faucets and back to the tank.

Additionally, the air infiltration can be reduced and the insulation increased for the building 10 by utilizing conventional techniques such as bronzing the windows, utilizing fully insulated all steel outer doors, weather stripping, and caulking.

Thus, it will be seen that according to the present invention a building has been provided, as well as an air temperature treatment system therefor, which greatly reduces the energy requirements compared to conventional structures, and allows the construction of a masonry building far exceeding all building code recommendations for masonry construction. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and systems.

What is claimed is:

1. A building comprising a plurality of exterior walls, defining an interior living area, a roof, defining an attic, a ceiling disposed between said roof and the interior living area and completely isolating the attic from the interior living area, air temperature treating means, ductwork for transferring treated air from said temperature treating means throughout the interior living area, at least one interior wall, and means for mounting ductwork within the interior living area and exterior the attic, adjacent said ceiling, said ductwork mounting areas comprising at least one soffit for mounting ductwork against said ceiling and against said interior wall.

2. A building as recited in claim 1 wherein said soffit comprises a supporting framework including side and bottom bars engaging a side and the bottom of said ductwork, and covering material disposed over at least said bottom bars.

3. A building as recited in claim 2 further comprising extensions of said supporting framework forming a trough having the uppermost surface thereof terminating short of said ceiling, and means for mounting a lighting fixture in said trough.

4. A building as recited in claim 1 wherein said soffit further comprises trough forming means having the uppermost surface thereof terminating short of said ceiling, and means for mounting a lighting fixture in said trough.

5. A building as recited in claim 1 further comprising a plurality of ceiling lighting fixtures, and means for mounting all of said ceiling lighting fixtures so that they are exterior of the attic and disposed below said ceiling.

6. A building as recited in claim 5 wherein said ceiling fixture mounting means comprise a false ceiling mounted below said ceiling.

7. A building as recited in claim 6 wherein said ceiling fixture mounting means further comprise an indirect lighting trough associated with said means for mounting ductwork within the interior living area adjacent said ceiling.

8. A building as recited in claim 1 further comprising electrical wiring and water pipes, and means for running all said wiring and pipes in the interior living area and exterior the attic.

9. A building as recited in claim 1 wherein said roof has about an 8/12 pitch, and further comprises a continuous ridge vent formed at the apex thereof, an overhang extending horizontally past said exterior walls, and vent means disposed in said overhang for allowing the admission of air into the attic so that it is heated and rises and passes out said ridge vent.

10. A building as recited in claim 1 wherein said exterior walls are masonry blocks, and further comprising a plurality of interior partitions, and insulation disposed between each interior partition and an adjoining exterior wall, and a plurality of electrical outlets and means for mounting said electrical outlets adjacent, but not in, said masonry block exterior walls.

11. A building as recited in claim 10 further comprising triple furring strips disposed on the interior of said exterior walls, and insulation disposed between said exterior walls and interior wall board, between said triple furring strips.

12. A building as recited in claim 1 wherein said air temperature treatment means comprises a first refrigerant circulating coil system including a compressor and expansion valve; a second refrigerant circulating coil system including a compressor and expansion valve; said first system having a first capacity, and said second system having a second capacity; a single air moving means for transferring air across a portion of at least said first coil system to change the temperature of the air and move it into the interior living space; and means for controlling said coil systems so that said first coil system is operational while said second coil system is not during normal conditions, below said first capacity level, and so that both said coil systems are operational during conditions above said first capacity level.

13. A building as recited in claim 1 further comprising a garage and a water heater, said water heater mounted in said garage isolated from the interior living space, and pipes extending from the water heater under said exterior walls into the interior living space.

* * * * *